US012692854B2

(12) United States Patent
Youman

(10) Patent No.: US 12,692,854 B2
(45) Date of Patent: Jul. 28, 2026

(54) SYSTEMS AND APPARATUSES FOR PORTABLE AIR DISTRIBUTION

(71) Applicant: Studsvik Inc., Wilmington, NC (US)

(72) Inventor: Benjamin Youman, Davis Junction, IL (US)

(73) Assignee: STUDSVIK INC., Wilimington, NC (US)

( * ) Notice: Subject to any disclaimer, the term of this patent is extended or adjusted under 35 U.S.C. 154(b) by 590 days.

(21) Appl. No.: 17/069,451

(22) Filed: Oct. 13, 2020

(65) Prior Publication Data

US 2022/0112908 A1 Apr. 14, 2022

(51) Int. Cl.

*F04B 41/02* (2006.01)
*F04B 35/04* (2006.01)
*F04B 35/06* (2006.01)

(52) U.S. Cl.

CPC ..... *F04B 41/02* (2013.01); *F04B 35/04* (2013.01); *F04B 35/06* (2013.01)

(58) Field of Classification Search

CPC ..... F04B 35/06; F04B 35/04; F04B 41/02
See application file for complete search history.

(56) References Cited

U.S. PATENT DOCUMENTS 4,163,134 A 7/1979 Budrose
4,293,281 A * 10/1981 Lamoreaux ..... F04B 35/00 417/44.11
5,022,587 A 6/1991 Hochstein
5,086,266 A 2/1992 Shiga et al.
5,939,799 A 8/1999 Weinstein
7,298,627 B2 11/2007 Hussaini et al.
7,353,841 B2 4/2008 Kono et al.
7,789,102 B2 * 9/2010 Beckman ..... F04B 49/20 137/505.11

(Continued)

FOREIGN PATENT DOCUMENTS

CN 105071475 A 11/2015
CN 206948024 U 1/2018

(Continued)

OTHER PUBLICATIONS

International Search Report and Written Opinion issued in related application No. PCT/US21/54561 mailed Mar. 1, 2022.

(Continued)

*Primary Examiner* — Christopher S Bobish
(74) *Attorney, Agent, or Firm* — Morgan, Lewis & Bockius LLP

(57) ABSTRACT

Systems and apparatuses are described for portable air distribution. A portable air unit may be used operate and/or assist operation of components/systems and provide critical instrument air supply in a wide variety of emergency industrial and commercial environments. The portable air unit may provide, via one or more solenoids, air from a battery powered integrated air compressor, as well as critical control power, to one or more air operated valves (AOVs) or Instrument Air Control Systems. The portable air unit may be configured, via an inverter and/or battery, to provide Alternating Current (AC) and/or a Direct Current (DC) electricity, power, and/or the like that may be used for diagnostic testing and/or any other critical power needs.

20 Claims, 3 Drawing Sheets

(56) References Cited

U.S. PATENT DOCUMENTS

| | | | | |
|---|---|---|---|---|
| 8,282,363 | B2 * | 10/2012 | Ohi | F04B 41/02 417/423.15 |
| 8,358,019 | B2 * | 1/2013 | Lemus | F04B 35/06 290/1 A |
| 8,579,600 | B2 * | 11/2013 | Vijayakumar | F04D 29/605 417/234 |
| 9,225,202 | B1 | 12/2015 | Kim et al. | |
| 9,337,517 | B2 * | 5/2016 | Chen | H01M 10/465 |
| 9,528,506 | B2 * | 12/2016 | Yoshida | F04B 39/066 |
| 9,583,942 | B2 | 2/2017 | Czarnecki | |
| 9,774,190 | B2 | 9/2017 | Mondal | |
| 9,816,507 | B2 * | 11/2017 | Vijayakumar | F04B 35/06 |
| 9,929,592 | B2 | 3/2018 | Liao et al. | |
| 10,718,338 | B2 * | 7/2020 | Vijayakumar | F04D 13/06 |
| 10,879,727 | B1 | 12/2020 | Cooper | |
| 11,274,674 | B2 * | 3/2022 | Morimura | F04B 49/08 |
| 11,614,081 | B2 * | 3/2023 | Wackwitz | F04B 35/04 417/63 |
| 11,635,070 | B2 * | 4/2023 | Hathcock | F04B 35/04 137/565.18 |
| 2006/0104836 | A1 | 5/2006 | Phillips | |
| 2007/0262641 | A1 | 11/2007 | Stone et al. | |
| 2007/0285049 | A1 | 12/2007 | Krieger et al. | |
| 2008/0181794 | A1 | 7/2008 | Steinfels et al. | |
| 2008/0185915 | A1 | 8/2008 | Wang | |
| 2008/0278003 | A1 | 11/2008 | Pouchet et al. | |
| 2010/0045107 | A1 | 2/2010 | Cohen et al. | |
| 2010/0303654 | A1 * | 12/2010 | Petersen | F04B 35/06 417/423.7 |
| 2011/0175451 | A1 | 7/2011 | Moon | |
| 2012/0119581 | A1 | 5/2012 | Silberbauer et al. | |
| 2012/0306274 | A1 | 12/2012 | Shetler, Jr. et al. | |
| 2013/0187464 | A1 | 7/2013 | Smith et al. | |
| 2016/0126787 | A1 * | 5/2016 | Liao | H02J 9/005 307/66 |
| 2017/0126164 | A1 | 5/2017 | Gibbs et al. | |
| 2018/0131226 | A1 | 5/2018 | Narla et al. | |
| 2018/0287408 | A1 | 10/2018 | Kutkut | |
| 2018/0323641 | A1 | 11/2018 | Lee et al. | |
| 2019/0036724 | A1 | 1/2019 | Stiefenhofer | |
| 2019/0047432 | A1 | 2/2019 | Clark | |
| 2022/0364555 | A1 * | 11/2022 | Teramoto | F04B 35/04 |
| 2023/0170831 | A1 * | 6/2023 | Hoshino | F04B 35/04 318/445 |

FOREIGN PATENT DOCUMENTS

| | | | |
|---|---|---|---|
| JP | H07177685 | A | 7/1995 |
| JP | 2008295133 | A | 12/2008 |
| JP | 2009118724 | A | 5/2009 |
| JP | 2015019580 | A | 1/2015 |
| JP | 2017118818 | A | 6/2017 |
| JP | 2018501487 | A | 1/2018 |
| WO | 2008126820 | A1 | 10/2008 |

OTHER PUBLICATIONS

Final Office Action dated Feb. 18, 2022, 23pgs.

International Search Report and Written Opinion issued in related application No. PCT/US20/43422 mailed Dec. 18, 2020.

U.S. Appl. No. 16/521,200, filed Jul. 24, 2019, David D. Heilman.

U.S. Appl. No. 17/870,443 (2023/0103983), filed Jul. 21, 2022 (Apr. 6, 2023), David D. Heilman (Constellation Energy Generation, LLC).

* cited by examiner

SYSTEMS AND APPARATUSES FOR PORTABLE AIR DISTRIBUTION

BACKGROUND

Power plants (e.g., nuclear power plants, electrical power plants, coal plants, etc.), industrial/commercial settings, and/or the like may include a variety of critical components, subsystems, and safety functions that must be maintained in the event of a power/service and/or service outage and/or loss of facility air to avoid safety degradation or damage. During extreme accident scenarios and/or natural disaster events, power plants, industrial/commercial settings, and/or the like may include specific time requirements for electric power, component operation, and/or system functionality to be restored to prevent damage and/or escalating the scenario/event. Power plants, industrial/commercial settings, and/or the like may include/require backup generators that provide emergency power to large portions of plant/facility equipment in the event of a loss of normal electrical supply power and/or resultant instrument and/or control air.

Preventing damage and/or escalating a scenario/event occurring at a power plant, industrial/commercial setting, and/or the like may require more than simply an expedient restoration of electrical power. Preventing damage and/or escalating a scenario/event often requires air supply systems to operate critical control valves and instruments. For example, power plants, industrial/commercial settings, and/or the like may include a large number of air-operated valves (AOVs) and other air controlled components. During a power outage and/or a related scenario, air compressors that routinely service the AOVs and other air controlled components may not be functional. Compressed air bottles and other packaged forms of air must be properly regulated, for example, to step down air pressure, before being used to service air-operated valves (AOVs) and other air controlled components, and are routinely configured with complex electrical solenoid control valves that may be difficult to operate in an emergency. As a result, restoring power and/or air supply to AOVs and other air controlled components may take several hours. Preventing damage and/or escalating a scenario/event occurring at a power plant, industrial/commercial setting, and/or the like requires expedient and efficient emergency power and air response.

SUMMARY

It is to be understood that both the following general description and the following detailed description are exemplary and explanatory only and are not restrictive. Provided are systems and apparatuses for protecting various critical instrumentation, electrical control circuits, power circuits, and/or air powered circuits/components when a primary power source fails (e.g., a primary power source is disrupted, etc.) by supplying air and/or power/electricity to various critical instrumentation, electrical control circuits, power circuits, and/or air powered circuits/components. An independent targeted and/or portable air supply system may provide control and/or instrument air to the most critical instrumentation, electrical control circuits, power circuits, and/or air powered circuits/components to provide a layer of redundancy and/or safety.

A portable air distribution system and/or apparatus may provide air to any system and/or component that utilizes air and/or air pressure as a mode of force, control, and/or diagnostic. The portable air distribution system may include a battery-powered integrated air compressor and output electricity (e.g., 0-240 VAC, 125 VDC, etc.) to solenoids of air-operated valves (AOV) to cause them to open, close, reposition, and/or the like. The portable air distribution system may be configured with a power generation apparatus and/or system, and may provide alternating current (AC) power output (e.g., a plug in, etc.) for ancillary equipment, diagnostic systems, and/or lighting.

The unique integration of a portable air unit operating via power from a DC Battery with control and instrumentation power provides both a safety and productivity benefit to facilitate emergency operation, maintenance, and testing of air components than any known apparatus, method, or system. The unique integration of a portable air unit operating via power from a DC Battery with control and instrumentation power avoids any need to mobilize bulky high energy air bottles, drive power, and instrument power to facilitate operation. The systems and apparatuses for portable air distribution enable the operation and testing of several air-operated components in a novel, efficient, safe, and productive manner and configuration.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, show examples and together with the description, serve to explain the principles of the systems and apparatuses described herein.

DETAILED DESCRIPTION

Figure 1:
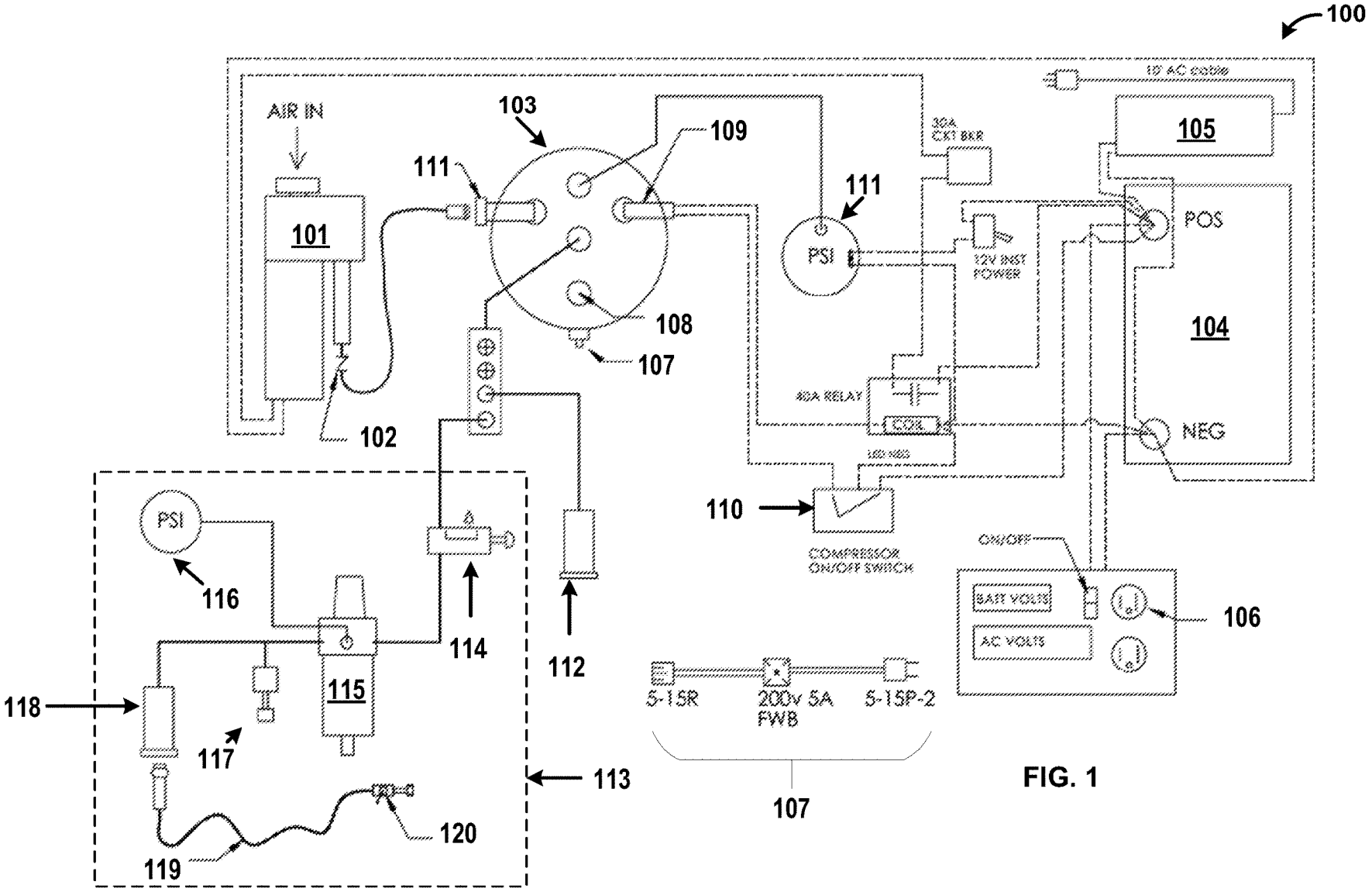
FIG. 1 illustrates an example system for portable air distribution.

Before the present systems and apparatuses are disclosed and described, it is to be understood that the methods and systems are not limited to specific components, or to particular implementations. It is also to be understood that the terminology used herein is to describe particular examples only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another example includes from the one particular value and/or to the other particular value. Similarly, when values are expressed as approximations, by use of the antecedent "about," it will be understood that the particular value forms another example. It will be further understood that the endpoints of each of the ranges are significant both in relation to the other endpoint, and independently of the other endpoint.

"Optional" or "optionally" means that the subsequently described event or circumstance may or may not occur, and that the description includes examples where said event or circumstance occurs and examples where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal example. "Such as" is not used in a restrictive sense, but for explanatory purposes.

Described herein are components that may be used to perform the described systems. These and other components are described herein, and it is understood that when combinations, subsets, interactions, groups, etc. of these components are described that while specific reference of each various individual and collective combinations and permutation of these may not be explicitly described, each is specifically contemplated and described herein, for all systems and apparatuses. This applies to all examples of this application including, but not limited to, steps in described methods. Thus, if there are a variety of additional steps that may be performed it is understood that each of these additional steps may be performed with any specific example or combination of examples of the described methods.

The present systems and apparatuses may be understood more readily by reference to the following description of preferred examples and the examples included therein and to the Figures and their previous and following description.

The systems and apparatuses are described below with reference to block diagrams and flowcharts of methods, systems, apparatuses and computer program products. It will be understood that each block of the block diagrams and flowcharts, and combinations of blocks in the block diagrams and flowcharts, respectively, may be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that may direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowcharts support combinations of means for performing the specified functions, combinations of steps for performing the specified functions and program instruction means for performing the specified functions. It will also be understood that each block of the block diagrams and flowcharts, and combinations of blocks in the block diagrams and flowcharts, may be implemented by special purpose hardware-based computer systems that perform the specified functions or steps, or combinations of special purpose hardware and computer instructions.

A portable air distribution system and/or apparatus may be used to protect various critical instrumentation, electrical control circuits, power circuits, and/or air powered circuits/components when a primary power source fails (e.g., a primary power source is disrupted, etc.). The portable air distribution system and/or apparatus may supply air and/or power/electricity to various critical instrumentation, electrical control circuits, power circuits, and/or air powered circuits/components.

A portable air distribution system and/or apparatus may provide both emergency and non-emergency air supply for critical valves and components. For example, a portable air distribution system may provide air to any system and/or component that utilizes air and/or air pressure as a mode of force, control, and/or diagnostic. The portable air distribution system may include a battery-powered integrated air compressor and output electricity (e.g., 0-240 VAC, 125 VDC, etc.) to solenoids of air-operated valves (AOV) to cause them to open, close, reposition, and/or the like. The portable air distribution system may be configured with a power generation apparatus and/or system, and may provide alternating current (AC) power output (e.g., a plug in, etc.) for ancillary equipment, diagnostic systems, and/or lighting.

FIG. 1 illustrates an exemplary system 100 for portable air distribution. The system 100 may be configured as separate components/devices and/or as a single device. The system 100 comprises portable air supply components with an integrated instrument and AC/DC control power to effectively and efficiently operate and control critical components and sub-systems of and/or within power plants (e.g., nuclear power plants, electrical power plants, coal plants, etc.), industrial/commercial settings, and/or the like. The system 100 may be configured, for example, on/with a wheeled platform/container configured to mount at least: a battery 104, an inverter 106, a compressor 101, an air tank 103, and an air pressure regulator 115.

To provide emergency and/or non-emergency air supply, the system 100 may include the compressor 101 (e.g., DC compressor, AC compressor, etc.). The compressor 101 may be, for example, a continuous duty, tankless, air compressor. The compressor 101 may be, for example, at least a 1.5 $ft^3$/min air compressor.

The compressor 101 may be electrically coupled to the battery 104. The battery 104 may include one or more batteries configured to store power and/or provide power (e.g., a power source, etc.). The battery 104 may include one or more rechargeable batteries and/or non-rechargeable batteries. The battery 104 may be, for example, a Lithium-Ion (Li+) battery, a lead-acid (Pb) battery, a Lithium Iron Phosphate (LiFePo) battery, or any type of rechargeable battery. The battery 104 may provide, for example, DC power. The battery 104 may be configured and/or rated for a voltage, such as 12 V, 24 V, 48 V, 125 V, 250 V, 400 V, and/or the like. The battery 104 may be configured and/or rated for output current. For example, the battery 104 may output 5 A, 50 A, 150 A, 300 A, etc. In an exemplary embodiment, the battery 104 may be a 12.8 V, 100 amps per hour (Ah). The battery 104 may be configured and/or rated for any voltage and/or current characteristics.

The battery 104 may receive electricity, voltage, and/or power from a charger 105. For example, the battery 104 may be electrically coupled to the charger 105. The charger 105 may be, for example, a 20 A, 14.4 V LiFePo charger. The charger 105 may be configured and/or rated for any voltage and/or current characteristics. The charger 105 may include an AC cable to attach to an AC power source when charging (e.g., providing electricity, voltage, power, etc.) the battery 104.

The battery 104 may receive and/or store electricity, voltage, and/or power from an inverter 106. For example, the battery 104 may be electrically coupled to the inverter 106. The battery 104 may provide electricity, voltage, and/or power to the inverter 106. The inverter 106 may be any device capable of converting AC power to DC power, as well as DC power to AC power. The inverter 106 may be a rectifier. The inverter 104 may be, for example, a 500 W inverter. The inverter 106 may be configured and/or rated for any power characteristics. The inverter 106 may receive electricity, voltage, and/or power from a source via an electrical connector 107.

The inverter 106 may receive DC power from the battery 104. For example, the inverter 106 may receive 12 VDC, 24 VDC, 48 VDC, 72 VDC, as well as voltages ranging from 100 VDC to 800 VDC. The inverter 106 may invert (e.g., convert) received DC power to AC power. The inverter 106 may output the inverted AC power. For example, the inverter 106 may output 110 VAC, 120 VAC, 208 VAC three-phase, 480 VAC three-phase, or any suitable output. The inverter 106 may provide the inverted AC power to a component of the system 100 and/or an external device/component. For example, the inverter 106 may comprise an internal transfer switch. The internal transfer switch may be capable of auctioneering AC power output to a component of the system 100 and/or an external device/component.

The inverter 106 may include, for example, a first power connection configured to provide DC power to and receive DC power from the battery 104. The inverter 106 may include, for example, a second power connection configured to receive AC external power from an external power source. The inverter 106 may include, for example, a third power connection configured to provide AC power to one or more loads. The inverter 106 may be configured to, for example, receive DC power from the first power connection, invert the received DC power to AC power. The inverter 106 may be configured to, provide the AC power to the third power connection. For example, the inverter 106 may auctioneer AC power from the second power connection and third power connection. The inverter 106 is capable of switching (e.g., automatically) between power connection, inputs, and/or the like of a component of the system 100 and/or an external device/component to maintain a constant output. The inverter 106 may provide continuous DC to AC power. For example, the inverter 106 may provide 500 W continuous DC to AC power (and/or and 1000 watts of peak power).

The inverter 106 may include one or more AC outlets and/or one or more USB quick charging ports. The inverter 106 may include one or more indicators that indicate the status of the inverter 106. For example, the inverter 106 may include one or more lights and/or displays that indicate the status of the inverter. In an exemplary embodiment, the lights comprise Light Emitting Diodes (LEDs).

The compressor 101 may be electrically coupled to the battery 104 and/or the inverter 106. The compressor 101 may receive electricity, voltage, and/or power from the battery 104 and/or the inverter 106. The compressor 101 may generate compressed air and/or airflow. The compressor 101 may include a check valve 102 to control the flow of air (and/or fluid) from the compressor 101. The compressor 101 may generate compressed air and/or airflow that, is at least partially controlled by the check valve 102 and provided to a tank 103 (e.g., an air tank, etc.). The compressor 101 may be coupled to the tank 103 via an air inlet 111 of the tank 103. The compressor 101 may be coupled to the air inlet 111 via one or more quick-connect (QC) fittings/sockets.

The tank 103 may be, for example, a half-gallon tank and/or a tank of any other dimensions. The tank 103 may include one or more components to control the flow of air (and/or fluid) from the tank 103. For example, the tank 103 may include a flow of a drain petcock 107, a safety relief valve 108, and/or a pressure switch 109.

The drain petcock 107 and/or a safety relief valve 108 may be used to drain/release air from the tank 103, for example, when the air pressure is at a certain/preset level. The pressure switch 109 may operate an electrical contact when a set pressure in the tank 103 has been reached. The switch may be designed to make contact either on pressure rise or on pressure fall. For example, the pressure switch 109 may be electrically coupled to an on/off switch 110 for the compressor 101. The pressure switch 109 may be used to automatically switch on/off the compressor, via the on/off switch 110, whenever a pressure within the tank 103 is at a certain/preset level. For example, the pressure switch 109 may be activated whenever air pressure within the tank is between 90-105 PSI and/or the like. To determine the air pressure within the tank 103, the tank 103 may be configured with and/or connected to a tank pressure gauge 111 (e.g., a dial gauge, etc.). The tank pressure gauge 111, the compressor 103, and or any other component of the system 100 may be electrically coupled to one or more circuit breakers, relays, power switches, and/or the like to regulate and/or control electricity, voltage, and/or power from the battery 104, the inverter 106, the charger 105, and/or any other component of the system 100.

The tank 103 may be configured with and/or coupled to one or more quick-connect (QC) raw air ports, such as a QC port 112. The QC port 112 may attach to a solenoid connector of an air operated valve (AOV) and/or the like. The tank 103 may be configured with and/or coupled to an air regulated control circuit 113.

The air regulated control circuit 113 may include a tank air dump valve 114, a pressure regulator 115, an air pressure gauge 116, an air bleeder 117, a quick connect regulated air outlet port 118, an air hose 119, and a manual valve 120. The tank air dump valve 114 enables air to be released (e.g., dumped, etc.) from the tank 103. The air pressure regulator 115 enables air pressure from the tank 103 to be reduced, for example, from high pressure to controlled lower output pressure. The air pressure regulator 115 may maintain a constant output pressure, for example, when there air pressure from the tank 103 fluctuates. The air pressure gauge 116 may be used to determine the air pressure regulated by the pressure regulator 115. The air bleeder 117 may be used to release trapped air, for example, air trapped any hose and/or connector of the air regulated control circuit 113.

The air regulated control circuit 113 may control/manage airflow of pressurized air according to one or more control parameters to operate critical control valves and instrumentation. The air regulated control circuit 113 may provide control and instrument air to critical components, for example, within a power plant (e.g., nuclear power plant, electrical power plant, coal plant, etc.), industrial/commercial setting, and/or the like. For example, the QC regulated air outlet port 118 may attach to a solenoid connector of air operated valve (AOV) and/or the like to provide pressurized air to one or more critical components and/or devices. The QC regulated air outlet port 118 may output air/air pressure, for example, from 0-250 PSI. The QC regulated air outlet port 118 may output air/air pressure that may be passed through, for example, the air hose 119 and/or the manual valve 120. The QC regulated air outlet port 118 and/or the manual valve 120 may attach/connect to a solenoid connector of an air operated valve (AOV) and/or the like.

The unique integration of the system 100 for portable air distribution provides both a safety and productivity benefit to facilitate emergency operation, maintenance, and testing of air components than any known apparatus, method, or system. The unique integration of the system 100 for portable air distribution avoids any need to mobilize bulky high energy air bottles, drive power, and instrument power to facilitate operation. The system 100 for portable air distribution enables the operation and testing of several air-operated components in a novel, efficient, safe, and productive manner and configuration.

Figure 2:
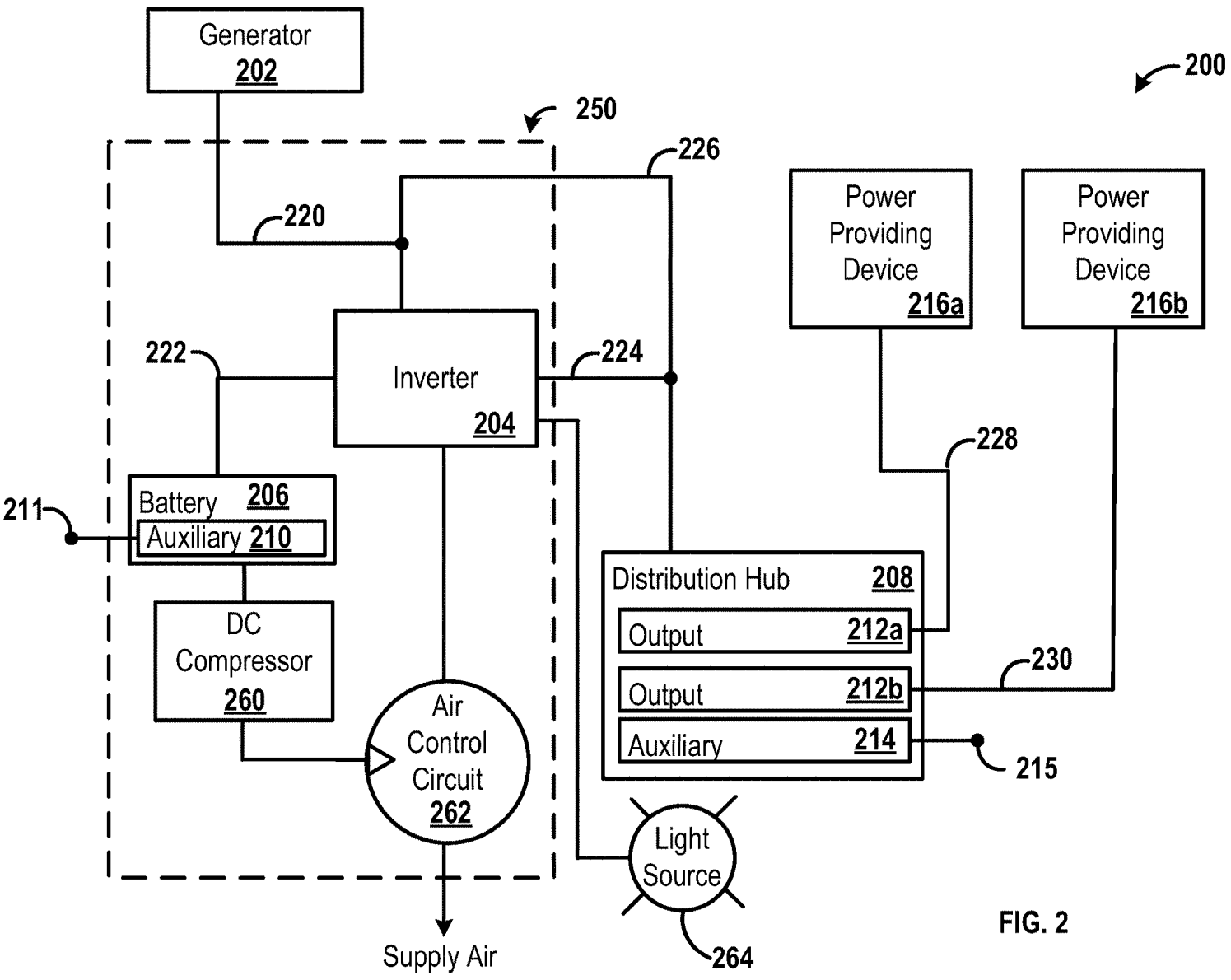
FIG. 2 illustrates an example system for portable air and emergency power distribution.

FIG. 2 illustrates a system 200 for portable air distribution and/or power generation/supply. The system 200 comprises portable air supply components with integrated instrument and AC/DC control power to effectively and efficiently operate and control critical components and sub-systems of and/or within power plants (e.g., nuclear power plants, electrical power plants, coal plants, etc.), industrial/commercial settings, and/or the like. The system 200 may provide lighting and AC Power to operate support equipment such as computers/computing devices, communication equipment, diagnostic/testing equipment, and/or the like. In an embodiment, the system 200 may be configured with any device/component of the system 100.

The system 200 may include a generator 202, an inverter 204, a battery 206, a distribution hub 208, a Direct Current (DC) compressor 260, an air regulated control circuit 262, and a light source 264. Further, the system 200 comprises an apparatus 250. The apparatus 250 may comprise the inverter 204 and the battery 206. Additionally, the apparatus 250 may include and/or be configured with any device/component of the system 100.

The generator 202 may be any generator capable of providing power. For example, the generator 202 may be capable of Alternating Current (AC). The generator 202 may output between 100 VAC and 250 VAC, as well as higher voltages. For example, the generator 202 may output 120 VAC and/or 240 VAC. The generator 202 may operate on any suitable fuel, such as gasoline, diesel, Liquid Propane Gas (LPG), natural gas, and so forth. The generator 202 may operate on two or more fuels. For example, the generator 202 may be capable of operating on both gasoline and LPG. The generator 202 may be capable of switching between the two fuels either manually or automatically. As an example, the generator 202 may default to running on gasoline stored within a gas tank associated with the generator 202. Once the generator 202 runs out of gasoline within the gas tank, the generator 202 may switch over to the LPG. As another example, the generator 202 may switch between two or more LPG tanks coupled with the generator 202. That is, when a first of the two or more LPG tanks run out of the LPG, the generator 202 may manually, or automatically, switch to a second of the two or more LPG tanks. The generator 202 may provide (e.g., output) power to the inverter 204 via an electrical connection 220. For example, the generator 202 may provide AC power to the inverter 204 via the electrical connection 220. Further, the generator 202 may provide power to the distribution hub 208 via the electrical connection 220 and an electrical connection 226. Stated differently, the generator 202 may bypass the inverter 204 and provide power directly to the distribution hub 208.

The inverter 204 may be any device capable of converting AC power to DC power, as well as DC power to AC power. For example, the inverter 204 may be a rectifier. The inverter 204 may receive power from the generator 202 via the electrical connection 222. For example, the inverter 204 may receive AC power from the generator 202 via the electrical connection 222. The inverter 204 may provide the received AC power to the distribution hub 208 via an electrical connection 226. The inverter 204 may convert the received AC power to DC power. The inverter 204 may provide (e.g., output) the DC power to the battery 206 via an electrical connection 224. As an example, the inverter 204 may charge the battery 206 via the electrical connection 224. The inverter 204 may charge the battery 206, while also providing AC power to the distribution hub 208. That is, the inverter 204 is capable of charging the battery 206, while simultaneously providing power to the distribution hub 208.

Further, the inverter 204 may receive DC power from the battery 206. For example, the inverter 204 may receive 12 VDC 24 VDC, 48 VDC, 72 VDC, as well as voltages ranging from 100 VDC to 800 VDC. The inverter 204 may invert (e.g., convert) the received DC power to AC power. The inverter 204 may output the inverted AC power. For example, the inverter 204 may output 110 VAC, 120 VAC, 208 VAC three-phase, 480 VAC three-phase, or any suitable output. The inverter 204 may provide the inverted AC power to the distribution hub 208 via an electrical connection 224. For example, the inverter 204 may comprise an internal transfer switch. The internal transfer switch may be capable of auctioneering AC power output to the distribution hub 208 between the electrical connection 220 (e.g., that is provided by the generator 202) and the electrical connection 222 (e.g., that is provided by the battery 206). Stated differently, the inverter 204 is capable of switching (e.g., automatically) between power inputs received from the generator 202, via the electrical connection 220, and from the battery 206, via the electrical connection 222, to maintain a constant output to the distribution hub 208, via the electrical connection 224. The inverter 204 may include one or more indicators that indicate the status of the inverter 204. For example, the inverter 204 may include one or more lights and/or displays that indicate the status of the inverter. In an exemplary embodiment, the lights comprise Light Emitting Diodes (LEDs).

The battery 206 may be one or more batteries configured to store power, as well as provide the stored power. The battery 206 may provide DC power. The battery 206 may include an associated voltage, such as a 12 V, 24 V, 48 V, 125 V, 250 V, 400 V, etc. battery. Further, the battery 206 may include an output current. For example, the battery 206 may output 5 A, 50 A, 150 A, 300 A, etc. In an exemplary embodiment, the battery 206 may be a 12 V battery with a rated output of up to 150 A. In another exemplary embodiment, the battery 206 may be a 24 V battery with a rated output of up to 300 A. As will be appreciated by one skilled in the art, the battery 206 may be a battery with any voltage and/or current characteristics.

The battery 206 may be any battery, such as rechargeable batteries or non-rechargeable batteries. The battery 206 may be a Lithium-Ion (Li+) battery, a lead-acid (Pb) battery, a Lithium Iron Phosphate (LiFePo) battery, or any type of rechargeable battery. The battery 206 comprises an auxiliary output 210. The auxiliary output 210 is capable of receiving and/or providing DC power to another device. For example, an apparatus capable of running on DC power may be coupled to the auxiliary output 210. As an example, a light may be coupled to the auxiliary output 210. As another example, an apparatus capable of providing DC power may be coupled to the auxiliary output 210. As an example, a maintenance battery charger may be coupled to the auxiliary output 210 to charge the battery 206.

The battery 206 may be one or more batteries configured to store power from the inverter 204. For example, the battery 206 may receive power from the inverter 204 via the electrical connection 222 and store the power from the inverter 204. Stated differently, the inverter 204 may charge the battery 206 via the electrical connection 222. Additionally, the battery 206 may provide power to the inverter 204. For example, the battery 206 may discharge (e.g., provide power) to the inverter 204 via the electrical connection 222. Accordingly, the battery 206 is capable of receiving power from the inverter 204, as well as providing power to the inverter 204. The distribution hub 208 may receive power from the generator 202 via the electrical connections 222 and 228. Additionally, the distribution hub 208 may receive power from the inverter via the electrical connection 226. The distribution hub 208 may comprise two or more outputs 212*a,b*, and an auxiliary 214.

The distribution hub 208 may provide AC power to the outputs 212*a,b*. For example, the distribution hub 208 may provide between 100-250 VAC power to the outputs 212*a,b*. The outputs 212*a,b* provide power to two or more power providing devices 216*a,b*. Specifically, the output 212*a* may provide power to the power providing device 216*a* via the electrical connection 228, and the output 212*b* may provide power to the power providing device 216*b* via the electrical connection 230. In an exemplary embodiment, the electrical connections 228, 230 comprise cables coupled with the distribution hub 208 and the power providing devices 216*a, b*. The power providing devices 216*a,b* may provide a variety of different power outputs. For example, the power providing devices 216*a,b* may provide AC power and DC power. As an example, the power providing device 216*a,b* may provide AC power and DC power simultaneously. The power output provided by the power providing devices 216*a,b* may be between 0-260 VDC, such as 24 VDC, 48 VDC, 125 VDC, as well as 0-250 VAC, such as 120 VAC, 240 VAC, or any suitable DC and/or AC output. The power providing devices 216*a,b* may include more than one output port associated with each of the power providing devices 216*a,b* such that the power providing devices 216*a,b* may provide power to a plurality of devices simultaneously.

The distribution 208 may include an auxiliary 214. The auxiliary 214 may provide power to one or more additional devices via an output connection 215. For example, the auxiliary 214 may couple the distribution hub 208 to another distribution hub. Stated differently, the auxiliary 214 provides the distribution hub 208 the capability to power one or more additional distribution hubs to provide additional power providing devices 216*a,b*. That is, the auxiliary 214 may include the capability to act as a pass-through that matches the voltage of the AC input provided to the distribution hub 208. The auxiliary 214 may provide 120 VAC, 240 VAC, and/or any AC power output. The auxiliary 214 may be an auxiliary output for providing power to an auxiliary device, such as a light, a power tool, or any electrical device. As another example, the auxiliary 214 may be an interface (e.g., a display, a light, etc.) that provides information associated with the distribution hub 208. As a further example, the auxiliary 214 may be an Input/Output (I/O) interface for communicating with one or more additional electronic devices.

While the electrical connections 220-230 are shown as direct connections between the various components of the system 200 for ease of explanation, a person skilled in the art would appreciate that the electrical connections 220-230 may comprise additional components, such as resistors, capacitors, inductors, breakers, switches, and so forth.

The light source 264 may be electrically coupled to a power source of the system. For example, the light source 264 may be coupled to an inverter, AC to DC converter, and/or battery of the system. The light source 264 may be a smart, self-diagnostic device to mitigate and/or eliminate resource-intensive light expenditure. The light source 264 may provide intense illumination and floodlight for emergency and non-emergency scenarios.

To provide emergency and/or non-emergency air supply, the DC compressor 260 may be electrically coupled to the battery 206. The DC compressor 260 may be electrically coupled to another electricity/power source of the system, such as the inverter 204, an AC to DC converter, and/or the like. The DC compressor 260 may include a continuous duty, tankless, air compressor. The DC compressor 260 may include any DC air compressor.

The DC compressor 260 may be coupled to the air regulated control circuit 262. The air regulated control circuit 262 may be used to control the air output of the system. For example, when air pressure from DC compressor 260 reaches a predetermined point, the pressure beneath one or more pistons may become enough to overcome a spring (or similar mechanism), causing a valve to move (e.g., close, etc.). Movement of the valve may reduce the amount of air output by the system (air regulated control circuit 262). When the valve is closed, one or more pistons may be prevented from drawing more air into the air regulated control circuit 262, and any air past the valve may be expelled from the air regulated control circuit 262 as output air/air pressure.

The air regulated control circuit 262 may output air/air pressure, for example, from 0-250 PSI. The one or more pistons of the air regulated control circuit 262 may include one or more oil controlled pistons that mitigate and/or prevent oil bypass into the air supply. The air regulated control circuit 262 may include one or more attachment elements (not shown) that are universally configured to attach to the solenoid connector of an air operated valve (AOV) and/or the like. The air regulated control circuit 262 may control/manage airflow of pressurized air received from the DC compressor 260 according to on one or more control parameters.

The unique integration of the system 200 for portable air distribution provides both a safety and productivity benefit to facilitate emergency operation, maintenance, and testing of air components than any known apparatus, method, or system. The unique integration of the system 200 for portable air distribution avoids any need to mobilize bulky high energy air bottles, drive power, and instrument power to facilitate operation. The system 200 for portable air distribution enables the operation and testing of several air-operated components in a novel, efficient, safe, and productive manner and configuration.

Figure 3:
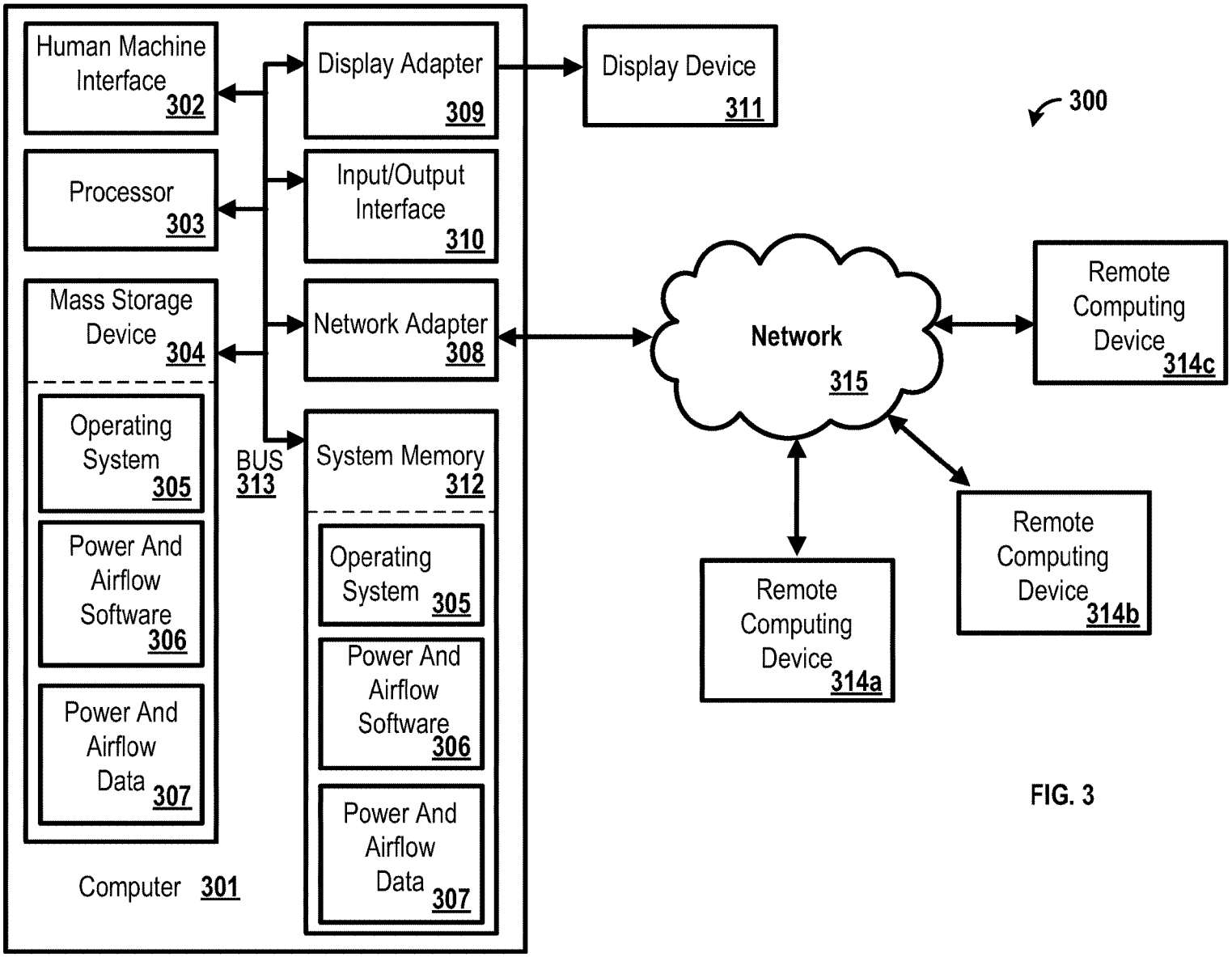
FIG. 3 illustrates a block diagram of an example computing device for portable air and emergency power distribution.

FIG. 3 shows an exemplary system 300. The inverter 106, the inverter 204, and/or the distribution hub 208 may be a computer 301 as shown in FIG. 3.

The computer 301 may comprise one or more processors 303, a system memory 312, and a bus 313 that couples various system components including the one or more processors 303 to the system memory 312. In the case of multiple processors 303, the computer 301 may utilize parallel computing. The bus 313 is one or more of several possible types of bus structures, including a memory bus or memory controller, a peripheral bus, an accelerated graphics port, or local bus using any of a variety of bus architectures.

The computer 301 may operate on and/or comprise a variety of computer-readable media (e.g., non-transitory).

The readable media may be any available media that is accessible by the computer 301 and may include both volatile and non-volatile media, removable and non-removable media. The system memory 312 has computer-readable media in the form of volatile memory, such as random access memory (RAM), and/or non-volatile memory, such as read-only memory (ROM). The system memory 312 may store data such as the power and airflow data 307 and/or program modules such as the operating system 305 and the power and airflow software 306 that are accessible to and/or are operated on by the one or more processors 303.

The computer 301 may also have other removable/non-removable, volatile/non-volatile computer storage media. FIG. 3 shows the mass storage device 304 which may provide non-volatile storage of computer code, computer-readable instructions, data structures, program modules, and other data for the computer 301. The mass storage device 304 may be a hard disk, a removable magnetic disk, a removable optical disk, magnetic cassettes or other magnetic storage devices, flash memory cards, CD-ROM, digital versatile disks (DVD) or other optical storage, random access memories (RAM), read-only memories (ROM), electrically erasable programmable read-only memory (EEPROM), and the like.

Any quantity of program modules may be stored on the mass storage device 304, such as the operating system 305 and the power and airflow software 306. Each of the operating system 305 and the power and airflow software 306 (or some combination thereof) may include elements of the program modules and the power and airflow software 306. The power and airflow 307 may also be stored on the mass storage device 304. The power and airflow 307 may be stored in any of one or more databases known in the art. Such databases may be DB2®, Microsoft® Access, Microsoft® SQL Server, Oracle®, MySQL, PostgreSQL, and the like. The databases may be centralized or distributed across locations within the network 315.

A user may enter commands and information into the computer 301 via an input device (not shown). Examples of such input devices comprise, but are not limited to, a keyboard, pointing device (e.g., a computer mouse, remote control), a microphone, a joystick, a scanner, tactile input devices such as gloves, and other body coverings, motion sensor, and the like These and other input devices may be connected to the one or more processors 303 via a human-machine interface 302 that is coupled to the bus 313, but may be connected by other interface and bus structures, such as a parallel port, game port, an IEEE 1394 Port (also known as a Firewire port), a serial port, network adapter 308, and/or a universal serial bus (USB).

The display device 311 may also be connected to the bus 313 via an interface, such as the display adapter 309. It is contemplated that the computer 301 may include more than one display adapter 309 and the computer 301 may include more than one display device 311. The display device 311 may be a monitor, an LCD (Liquid Crystal Display), light-emitting diode (LED) display, television, smart lens, smart glass, and/or a projector. In addition to the display device 311, other output peripheral devices may be components such as speakers (not shown) and a printer (not shown) which may be connected to the computer 301 via the Input/Output Interface 310. Any step and/or result of the methods may be output (or caused to be output) in any form to an output device. Such output may be any form of visual representation, including, but not limited to, textual, graphical, animation, audio, tactile, and the like. The display device 311 and computer 301 may be part of one device, or separate devices.

The computer 301 may operate in a networked environment using logical connections to one or more remote computing devices 314*a,b,c*. A remote computing device may be a personal computer, computing station (e.g., workstation), portable computer (e.g., laptop, mobile phone, tablet device), smart device (e.g., smartphone, smartwatch, activity tracker, smart apparel, smart accessory), security and/or monitoring device, a server, a router, a network computer, a peer device, edge device, and so on. Logical connections between the computer 301 and a remote computing device 314*a,b,c* may be made via a network 315, such as a local area network (LAN) and/or a general wide area network (WAN). Such network connections may be through the network adapter 308. The network adapter 308 may be implemented in both wired and wireless environments. Such networking environments are conventional and commonplace in dwellings, offices, enterprise-wide computer networks, intranets, and the Internet.

Application programs and other executable program components such as the operating system 305 are shown herein as discrete blocks, although it is recognized that such programs and components reside at various times in different storage components of the computing device 301, and are executed by the one or more processors 303 of the computer. An implementation of the power and airflow 306 may be stored on or sent across some form of computer-readable media. Any of the described methods may be performed by processor-executable instructions embodied on computer-readable media.

While specific configurations have been described, it is not intended that the scope be limited to the particular configurations set forth, as the configurations herein are intended in all respects to be possible configurations rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of configurations described in the specification.

It will be apparent to those skilled in the art that various modifications and variations may be made without departing from the scope or spirit. Other configurations will be apparent to those skilled in the art from consideration of the specification and practice described herein. It is intended that the specification and described configurations be considered as exemplary only, with a true scope and spirit being indicated by the following claims.

What is claimed is:

1. A portable apparatus, comprising:

an enclosure, including:

one or more batteries;

a plurality of electrical outlets, each outlet of the plurality of electrical outlets configured to (i) couple to a respective external device and (ii) output, from the portable apparatus to the respective external device, an output voltage selected from a plurality of voltages;

an air compressor;

an inverter configured to be electrically coupled to the air compressor and electrically coupled to the one or more batteries, the inverter configured to:

receive a first DC power from the one or more batteries;

invert the first DC power to a first AC power; and provide the first AC power via a respective outlet of the plurality of electrical outlets;

the air compressor electrically coupled to the one or more batteries and the inverter, and configured to generate pressurized air;

an air tank, configured to:

receive the pressurized air from the air compressor; and output the pressurized air via one or more air outlet ports of the portable apparatus;

an air pressure regulator coupled to the air tank and configured to control a release of the pressurized air from the air tank via a first regulated air outlet port of the portable apparatus;

a processor; and memory coupled to the processor, the memory storing instructions that, when executed by the processor, cause the portable apparatus to, during operation of the portable apparatus:

provide power to a solenoid of an air operated valve (AOV) of an external system that has lost power, wherein the external system is configured to be coupled to a first electrical outlet, of the plurality of electrical outlets, of the portable apparatus; and supply air at a first air pressure to the AOV via the first regulated air outlet port of the portable apparatus, thereby causing the AOV to open, close, and/or reposition.

2. The portable apparatus of claim 1, wherein the inverter is further configured to:

receive a second AC power from an external generator that is electrically coupled to the inverter;

convert the second AC power to a second DC power; and output the second DC power via a second electrical outlet of the plurality of electrical outlets.

3. The portable apparatus of claim 1, wherein at least one battery of the one or more batteries comprises an auxiliary port to provide external DC power or to receive external DC power.

4. The portable apparatus of claim 1, wherein at least one battery of the one or more batteries is configured to receive DC power from a battery charger.

5. The portable apparatus of claim 1, wherein the inverter is further configured to output DC power, the DC power ranging from 0 W to 500 W.

6. The portable apparatus of claim 1, wherein the one or more outlets comprise 120 VAC outlets.

7. The portable apparatus of claim 1, wherein the air tank comprises a capacity of 1.5 gallons.

8. The portable apparatus of claim 1, wherein the one or more air outlet ports comprise one or more quick connect (QC) outlet ports.

9. The portable apparatus of claim 1, further comprising one or more light emitting diodes (LED) configured to indicate a respective status of the inverter.

10. The portable apparatus of claim 1, wherein the enclosure comprises a wheeled container configured to the one or more batteries, the inverter, the air tank, and the air pressure regulator.

11. The portable apparatus of claim 1, wherein the enclosure is further configured to mount a lighting apparatus, wherein the lighting apparatus is configured to provide ambient lighting.

12. The portable apparatus of claim 1, wherein the plurality of voltages comprises voltage values ranging from 110 VAC to 480 VAC.

13. The portable apparatus of claim 1, wherein the plurality of voltages comprises voltage values ranging from 12 VDC to 400 VDC.

14. The portable apparatus of claim 1, wherein during operation of the portable apparatus:

a second electrical outlet, of the plurality of electrical outlets, is configured to be electrically coupled to a diagnostic system and provide an AC power output for the diagnostic system.

15. An apparatus, comprising:

one or more batteries;

an air compressor coupled to the one or more batteries, wherein the air compressor is configured to generate pressurized air;

an air control unit configured to:

receive the pressurized air from the air compressor, and output, via one or more attachment elements, the pressurized air based on one or more control parameters;

an inverter configured to be electrically coupled to the one or more batteries and to the air control unit, wherein the inverter is configured to:

receive DC power from the one or more batteries and invert the DC power to a first AC power, receive a second AC power from an external power source, and provide the first AC power and/or the second AC power to one or more loads, a distribution hub configured to:

receive first AC power from the inverter and/or receive the second AC power from the external power source, and output power via one or more outputs of the distribution hub;

a processor; and memory coupled to the processor, the memory storing instructions that, when executed by the processor, cause the apparatus to, during operation of the apparatus:

provide power to a solenoid of an air operated valve (AOV) of an external system that has lost power, wherein the external system is configured to be electrically coupled to the one or more outputs of the distribution hub; and supply air at a first air pressure to the AOV via the one or more attachment elements of the air control unit, thereby causing the AOV to open, close, and/or reposition.

16. The apparatus of claim 15, wherein the one or more attachment elements are configured to attach to the solenoid of the AOV.

17. The apparatus of claim 15, wherein the distribution hub further comprises a voltage and ampere indicator configured to display an AC input voltage and display a total current through the distribution hub.

18. The apparatus of claim 15, wherein the external power source comprises an AC power generator.

19. The apparatus of claim 18, wherein the AC power generator is configured to be powered by at least one of gasoline, liquid propane gas, natural gas, or diesel fuel.

20. The apparatus of claim 18, wherein the AC power generator is configured to switch manually between gasoline and liquid propane gas.

* * * * *